US009319761B2

(12) United States Patent
Wiederholt et al.

(10) Patent No.: US 9,319,761 B2
(45) Date of Patent: Apr. 19, 2016

(54) MICROPHONE

(75) Inventors: Bernd Wiederholt, Hannover (DE); Lars Heinrich, Hannover (DE); Dirk Hackbarth, Wedmark (DE); Gerd Soehnholz, Essel (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 185 days.

(21) Appl. No.: 13/811,709

(22) PCT Filed: Mar. 29, 2012

(86) PCT No.: PCT/EP2012/055608

§ 371 (c)(1),
(2), (4) Date: Jan. 17, 2014

(87) PCT Pub. No.: WO2012/130927

PCT Pub. Date: Oct. 4, 2012

(65) Prior Publication Data

US 2014/0153739 A1 Jun. 5, 2014

(30) Foreign Application Priority Data

Mar. 29, 2011 (DE) ..... 10 2011 006 299

(51) Int. Cl.
*H04R 1/02* (2006.01)
*H04R 1/08* (2006.01)
*H04R 1/28* (2006.01)

(52) U.S. Cl.
CPC ..... *H04R 1/02* (2013.01); *H04R 1/083* (2013.01); *H04R 1/2892* (2013.01)

(58) Field of Classification Search
CPC ..... H04R 1/02; H04R 1/083; H04R 1/2892
USPC ..... 381/91, 375, 369, 368, 361, 374, 362; 181/208
See application file for complete search history.

(56) References Cited

U.S. PATENT DOCUMENTS 4,628,525 A * 12/1986 Iwahara ..... H04R 5/027 381/26
2003/0197316 A1* 10/2003 Baumhauer, Jr. ..... H04R 1/083 267/136
2006/0002576 A1* 1/2006 Akino ..... H04R 1/021 381/361

FOREIGN PATENT DOCUMENTS

WO WO 99/14981 3/1999

* cited by examiner

*Primary Examiner* — Davetta W Goins
*Assistant Examiner* — Oyesola C Ojo
(74) *Attorney, Agent, or Firm* — Frommer Lawrence & Haug LLP

(57) ABSTRACT

There is provided a microphone comprising a microphone capsule and a microphone capsule suspension. The microphone capsule suspension has a first and a second housing portion and a decoupling unit. In that case the microphone capsule is mounted to the decoupling unit for solid-borne sound decoupling. The decoupling unit is in turn fixed to the first and/or second housing portion. The decoupling unit has a shape-changing portion which under loading changes its shape. The decoupling unit has at least two arms which each have a first and a second end. The second ends of the arms respectively have a fixing portion for receiving a microphone capsule. Each arm has a shape-changing portion which changes its shape under a first loading and an elastic portion which permits elastic deformation in respect of length as from a second loading.

8 Claims, 3 Drawing Sheets

MICROPHONE

The present application claims priority from PCT Patent Application No. PCT/EP2012/055608 filed on Mar. 29, 2012, which claims priority from German Patent Application No. DE 10 2011 006 299.8 filed on Mar. 29, 2011, the disclosures of which are incorporated herein by reference in their entirety.

FIELD OF THE INVENTION

The present invention concerns a microphone.

It is noted that citation or identification of any document in this application is not an admission that such document is available as prior art to the present invention.

One problem in the design of microphones is that of reducing the transmission of solid-borne sound from the microphone housing to the microphone capsule. For that purpose a microphone capsule can be disposed in swinging relationship in or on the housing of the microphone.

As general state of the art attention is directed to the documents US 2003/0197316 A1, U.S. Pat. No. 4,628,525 and WO 99/14981 A1.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

An object of the present invention is to provide a microphone having improved solid-borne sound decoupling of the microphone capsule, wherein it is possible to achieve a compact structure for the microphone.

Thus there is provided a microphone comprising a microphone capsule and a microphone capsule suspension. The microphone capsule suspension has a first and a second housing portion and at least one decoupling unit. In that case the microphone capsule is mounted to the decoupling unit for solid-borne sound decoupling. The decoupling unit is in turn fixed to the first and/or second housing portion. The decoupling unit has a shape-changing portion which under loading changes its shape.

The decoupling unit has at least two arms which each have a first and a second end. The second ends of the arms respectively have a fixing portion for receiving the microphone capsule. Each arm has a shape-changing portion which changes its shape under a first loading and an elastic portion which permits elastic deformation in respect of length as from a second loading.

In an aspect of the present invention the microphone capsule has a first and a second end, wherein the first and second ends are respectively supported in a decoupling unit, that is to say the microphone has two decoupling units (one decoupling unit at the first end and one decoupling unit at the second end).

In a further aspect of the invention the decoupling unit is made from a single material.

In a further aspect of the invention the shape-changing portions are of a round, annular, oval or rectangular configuration or have at least one hole in the center.

According to the invention the decoupling unit has a non-linear spring characteristic.

According to the invention there is provided a microphone having a microphone capsule supported swingingly in or on the microphone housing. Decoupling is improved, the softer the swinging support is. The resonance frequency of that swinging support however should be outside the audible range. Additionally or alternatively thereto the swinging system should involve a low quality. In addition, however it is to be noted that, at very low resonance frequencies of the swinging support, a mechanical instability can occur so that further deflections of the microphone capsule can take place upon movement of the microphone. To reduce the excessive deflections of the microphone capsule the swinging support can have a material which has very high internal damping (for example butyl).

In particular the invention concerns the notion of providing a swinging support (decoupling unit) which has a spring characteristic in respect of the elastic support, that is of a progressive configuration, to increase mechanical stability. Thus the swinging support can be in the form of a soft spring around the rest point, while at high levels of deflection it is in the form of a hard spring. Optionally that progressive configuration can be provided in all three axes. Optionally limbs or portions of the decoupling unit can be bent out of the force line or there can initially be a change in the shape of the portions. When slight deflections are involved there can be a spring force due to bending of the material. If however the curve is then fully stretched, that involves a large degree of deflection of the spring force because of material stretching. In order for example to bend thin limbs of the spring, very much finer forces are required than for stretching the material, whereby then it is possible to achieve the desired progressivity in respect of the spring characteristic.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
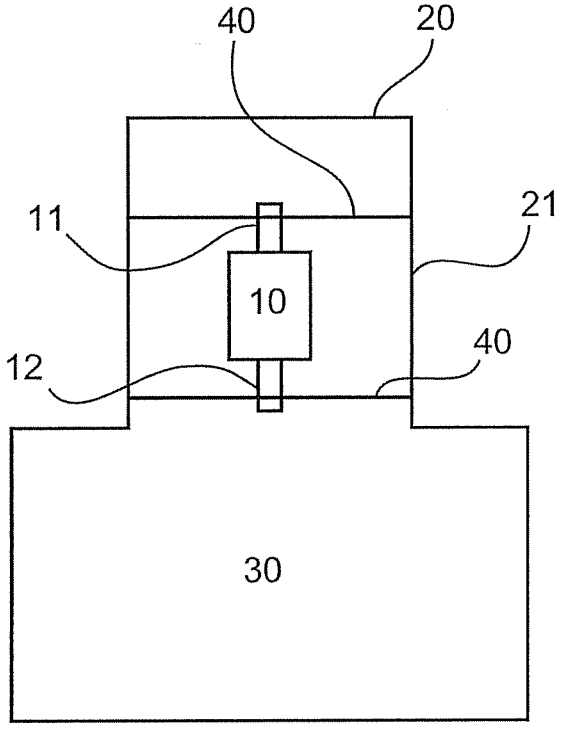
FIG. 1 shows a diagrammatic view of a microphone capsule suspension of a microphone according to a first embodiment.

FIG. 1 shows a diagrammatic view of a microphone capsule suspension of a microphone according to a first embodiment. The microphone has a housing 30 (first housing portion), a transducer housing 10 or a microphone capsule, a second housing portion 20 of the microphone capsule, and a solid-borne sound decoupling unit 40. The transducer housing 10 has a first and a second end 11, 12. The decoupling unit 40 is fixed to a first housing portion 20 and accommodates the microphone capsule so that it is possible to implement solid-borne sound decoupling. Optionally both the first and also the second end 11, 12 of the microphone capsule can be fixed at or to the decoupling unit 40.

Figure 2:
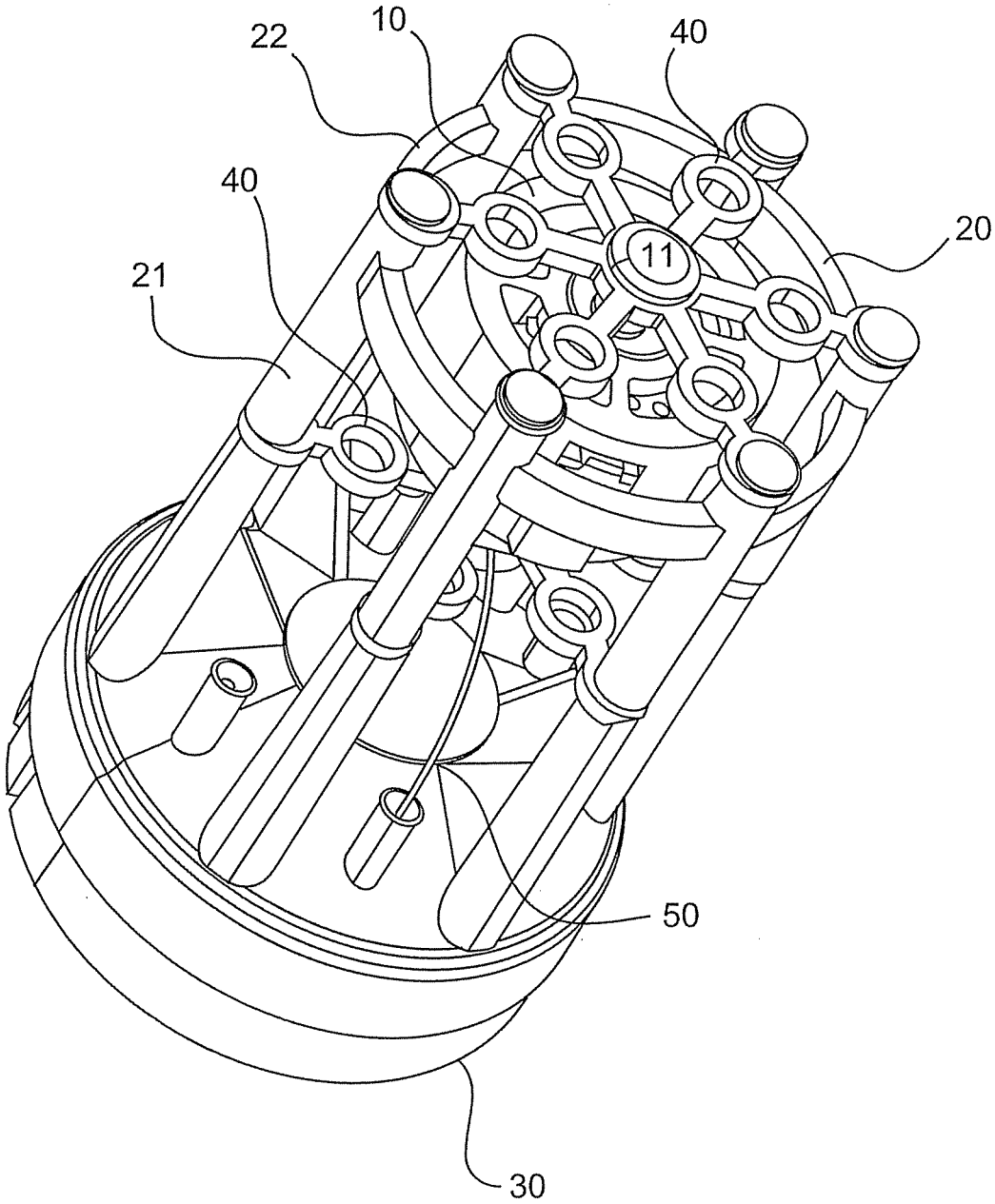
FIG. 2 shows a diagrammatic perspective view of a microphone capsule suspension of a microphone according to a second embodiment.

FIG. 2 shows a diagrammatic perspective view of a microphone capsule suspension of a microphone according to a second embodiment. The microphone has a housing 30 (second housing portion), a transducer housing or a microphone capsule 10, a first housing portion 20 and at least one decoupling unit 40 for accommodating the microphone capsule. In this case the decoupling unit 40 is fixed to the first housing portion 20. Thus the microphone capsule 10 is connected to the housing (second housing portion) of the microphone only by way of the decoupling units 40.

Optionally the first housing portion can be in the form of a number of bars 21 with a connecting ring 22 at one end. In that case the solid-borne sound decoupling unit 40 can be fixed at or to the bars and can accommodate the microphone capsule in solid-borne sound decoupled relationship.

Figure 3:
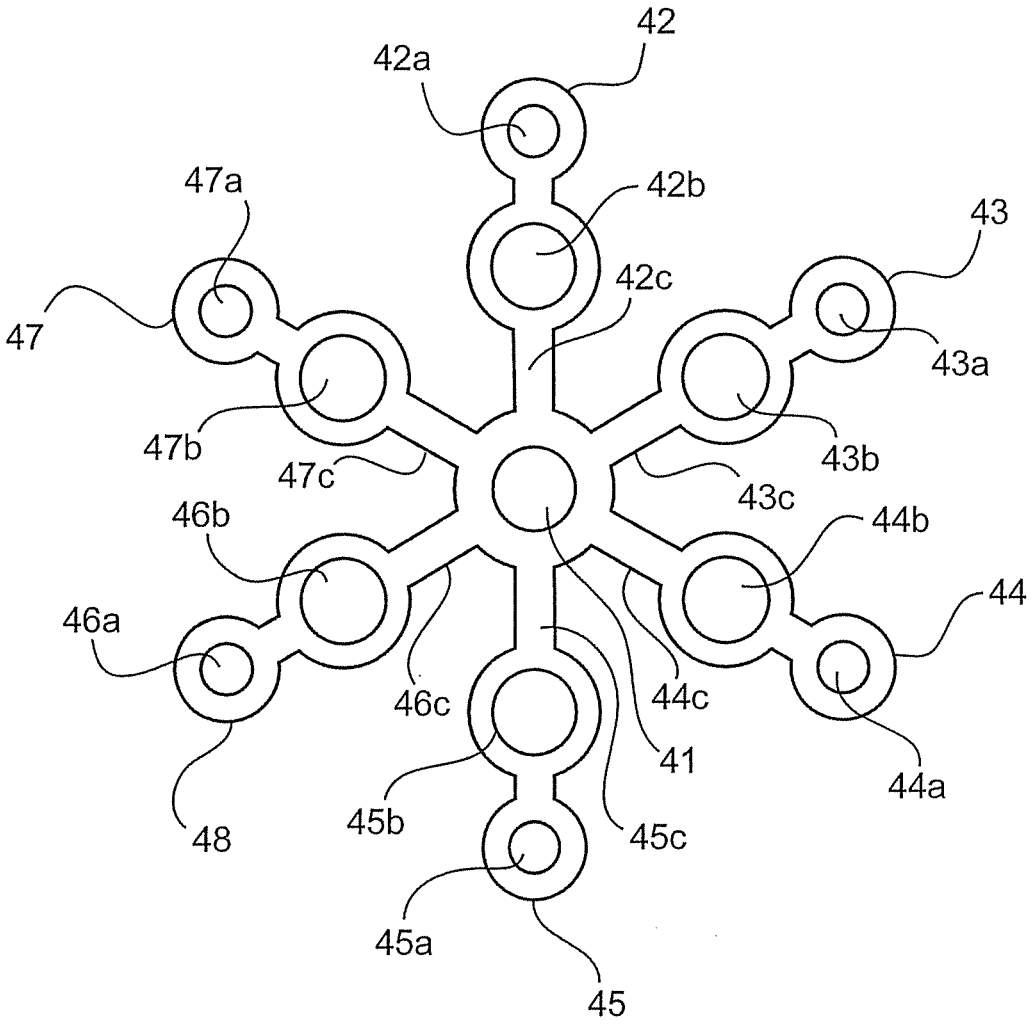
FIG. 3 shows a diagrammatic view of a spring unit of a microphone capsule suspension of a microphone according to a third embodiment.

FIG. 3 shows a diagrammatic view of a decoupling unit of a microphone capsule suspension of a microphone according to a third embodiment. The decoupling unit of the third embodiment can be used in a microphone capsule suspension according to the first and/or second embodiment. The decoupling unit 40 has a receiving portion 41 for receiving an end of a microphone capsule and for example six arms 42, 43, 44, 45, 46, 47 respectively connected to the receiving portion 41. As an alternative to the six arms it is also possible to provide more or fewer arms. Each of the (six) arms 42-47 has at its first end 42*a*-47*a* a fixing portion for fixing to a second housing portion 20 (or the bars 21) of the microphone capsule suspension 20. The second end 42*c*-47*c* of each of the six arms is connected to a receiving portion 41. A shape-changing portion 42*b*-47*b* is respectively present between the first end 42*a*-47*a* and the second end 42*c*-47*c*. The shape-changing portion 42*b*-47*b* can be of a round, annular, oval, rectangular, etc configuration. Alternatively or additionally the shape-changing portion 42*b*-47*b* can be provided with at least hole in the center.

In particular the shape-changing portion 42*b*-47*b* is adapted to already change its shape in the event of slight deflections of a microphone capsule 10 which is placed in the receiving portion 41.

In the case of larger deflections of the microphone capsule placed in the receiving portion 41, after the change in the shape of the shape-changing portions, the first and/or second ends can involve an elastic deformation. For example this can involve elastic length deformation of the second end 42*c*-47*c*.

Thus there is provided a decoupling unit 40 having a progressive-elastic mounting support. Around the rest point the support is in the form of a soft spring (shape-changing portions) due to the provision of the shape-changing portions. In the case of larger deflections however the decoupling unit (second ends 42*c*-47*c*) can be in the form of a hard spring as there, elastic length deformation of the first and/or second portion or the material provided there can occur. When the shape-changing portions are fully straightened out, the spring force of the decoupling unit is afforded by stretching or lengthwise elongation of the material.

The microphone according to the invention has two decoupling units which respectively receive a first and second end of a microphone capsule and serve for solid-borne sound decoupling. The decoupling unit has a shape-changing portion and an elastic portion. Up to a first loading the shape of the shape-changing portion is changed. With an increase in loading this involves elastic length deformation of the elastic portion. Thus the decoupling unit has both a shape-changing portion and also an elastic portion.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A microphone comprising:

a microphone capsule; and a microphone capsule suspension;

wherein the microphone capsule suspension comprises:

a first and a second housing portion; and at least one decoupling unit configured as a resilient support;

wherein the microphone capsule is mounted to the decoupling unit for solid-borne sound decoupling;

wherein the decoupling unit comprises at least two arms which each have a first and a second end;

wherein the second ends of the arms are connected to a fixing portion which receives and supports the microphone capsule; and wherein each arm has, between the first end and the second end:

a shape-changing portion which changes its shape under a first loading to exert a first spring force, and which elastically deforms under a third loading to exert a third spring force which is greater than the first spring force; and an elastic portion, located behind the shape-changing portion, which elastic deforms in a length direction under a second loading.

2. The microphone as set forth in claim 1;

wherein the microphone capsule suspension has two decoupling units; and wherein the microphone capsule is mounted with a first end of the microphone capsule in one decoupling unit, and a second end of the microphone capsule in the other decoupling unit.

3. The microphone as set forth in claim 1;

wherein the decoupling unit is made from one material.

4. The microphone as set forth in claim 1;

wherein the shape-changing portions have a configuration which is round, annular, oval, or rectangular, or have a configuration with at least one hole in the center.

5. The microphone as set forth in claim 2;

wherein the decoupling unit is made from one material.

6. The microphone as set forth in claim 2;

wherein the shape-changing portions have a configuration which is round, annular, oval, or rectangular, or have a configuration with at least one hole in the center.

7. The microphone as set forth in claim 3;

wherein the shape-changing portions have a configuration which is round, annular, oval, or rectangular, or have a configuration with at least one hole in the center.

8. The microphone as set forth in claim 5;

wherein the shape-changing portions have a configuration which is round, annular, oval, or rectangular, or have a configuration with at least one hole in the center.

* * * * *